US011303004B2

(12) United States Patent
Yung et al.

(10) Patent No.: US 11,303,004 B2
(45) Date of Patent: Apr. 12, 2022

(54) MICROSTRIP-TO-WAVEGUIDE TRANSITION INCLUDING A SUBSTRATE INTEGRATED WAVEGUIDE WITH A 90 DEGREE BEND SECTION

(71) Applicant: Hughes Network Systems, LLC, Germantown, MD (US)

(72) Inventors: Yu Yung, Germantown, MD (US); Rajesh Joshi, Clarksburg, MD (US); George Eapen, Boyds, MD (US); Guo Chen, Damascus, MD (US); Kumud Patel, Clarksburg, MD (US)

(73) Assignee: HUGHES NETWORK SYSTEMS, LLC, Germantown, MD (US)

( * ) Notice: Subject to any disclaimer, the term of this patent is extended or adjusted under 35 U.S.C. 154(b) by 205 days.

(21) Appl. No.: 16/436,337

(22) Filed: Jun. 10, 2019

(65) Prior Publication Data

US 2020/0388899 A1 Dec. 10, 2020

(51) Int. Cl.

| | |
|---|---|
| ***H01P 5/107*** | (2006.01) |
| ***H01P 3/08*** | (2006.01) |
| ***H01Q 9/04*** | (2006.01) |
| ***H01P 3/12*** | (2006.01) |
| ***H01P 1/02*** | (2006.01) |
| ***H01Q 19/13*** | (2006.01) |

(52) U.S. Cl.

CPC ..... *H01P 5/107* (2013.01); *H01P 1/025* (2013.01); *H01P 3/081* (2013.01); *H01P 3/121* (2013.01); *H01Q 9/045* (2013.01); *H01Q 19/132* (2013.01)

(58) Field of Classification Search

CPC ..... H01P 5/103; H01P 5/107; H01P 1/022; H01P 1/035; H01P 1/027; H01P 3/121

USPC ..... 333/26

See application file for complete search history.

(56) References Cited

U.S. PATENT DOCUMENTS

| | | | | |
|---|---|---|---|---|
| 7,439,822 | B2 * | 10/2008 | Shimura et al. | H01P 5/08 333/26 |
| 2010/0245155 | A1 * | 9/2010 | Miyazato et al. | H01P 3/081 342/104 |
| 2016/0043455 | A1 * | 2/2016 | Seler et al. | H04B 5/00 333/26 |
| 2017/0207510 | A1 * | 7/2017 | Park et al. | H01P 3/165 |

* cited by examiner

*Primary Examiner* — Benny T Lee

(74) *Attorney, Agent, or Firm* — Global IP Counselors, LLP

(57) ABSTRACT

A microstrip-to-waveguide transition includes a substrate and a waveguide. The substrate has a metal layer, a ground layer and a dielectric layer disposed between the metal layer and a ground layer. The substrate includes a microstrip line impedance transformer and a substrate integrated waveguide that is electromagnetically coupled to the microstrip line impedance transformer. The substrate integrated waveguide has a 90 degree substrate integrated waveguide bend section at an end portion thereof. The waveguide is arranged perpendicularly relative to the substrate. The waveguide is electromagnetically coupled to the substrate integrated waveguide at the 90 degree substrate integrated waveguide bend section. The microstrip-to-waveguide transition is free of a back-short at a location corresponding to the 90 degree substrate integrated waveguide bend section.

19 Claims, 7 Drawing Sheets

MICROSTRIP-TO-WAVEGUIDE TRANSITION INCLUDING A SUBSTRATE INTEGRATED WAVEGUIDE WITH A 90 DEGREE BEND SECTION

BACKGROUND

Field of the Invention

This invention generally relates to a microstrip-to-waveguide transition. This invention also relates to a radio assembly with a microstrip-to-waveguide transition.

Background Information

Generally, microstrip-to-waveguide transitions are known in the field of radio engineering. Specifically, microstrip-to-waveguide transitions can be generally categorized into two types. The first type is a microstrip-to-waveguide transition having a microstrip line and a waveguide that are perpendicular to each other. The second type is a microstrip-to-waveguide transition having a microstrip line and a waveguide that are arranged along a line.

The first type of microstrip-to-waveguide transitions employ a bandwidth limited radiating patch with a back-short that is positioned quarter wavelength away from the radiating patch. The position of the back-short is very sensitive to the electrical performance of the microstrip-to-waveguide transitions. Furthermore, for low loss application, materials from a main substrate, on which the radiating patch is located, to the back-short is removed to form a recess on the main substrate.

SUMMARY

However, processing of the radiating patch, the back-short and the recess becomes more difficult as the size of the microstrip-to-waveguide transitions become smaller. In particular, as the corresponding frequency band for the microstrip-to-waveguide transitions becomes higher, the size of the microstrip-to-waveguide transitions gets smaller.

Generally, the present disclosure is directed to various features of a microstrip-to-waveguide transition and a radio assembly.

In accordance with one aspect of the present disclosure, a microstrip-to-waveguide transition includes a substrate and a waveguide. The substrate has a metal layer, a ground layer and a dielectric layer disposed between the metal layer and a ground layer. The substrate includes a microstrip line impedance transformer and a substrate integrated waveguide that is electromagnetically coupled to the microstrip line impedance transformer. The substrate integrated waveguide has a 90 degree substrate integrated waveguide bend at an end portion thereof. The waveguide is arranged perpendicularly relative to the substrate at the end portion of the substrate integrated waveguide. The waveguide is electromagnetically coupled to the substrate integrated waveguide at the 90 degree substrate integrated waveguide bend. The microstrip-to-waveguide transition is free of a back-short at a location corresponding to the 90 degree substrate integrated waveguide bend. This configuration can reduce the manufacturing difficulty, save the production cost and also provide superior broadband electrical performance, for example.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings, where like features are denoted by the same reference labels throughout the drawings and specification description. It will be apparent to those skilled in the art from this disclosure that the following descriptions of the embodiments are provided for illustration only and not for the purpose of limiting the invention as defined by the appended claims and their equivalents.

Figure 1:
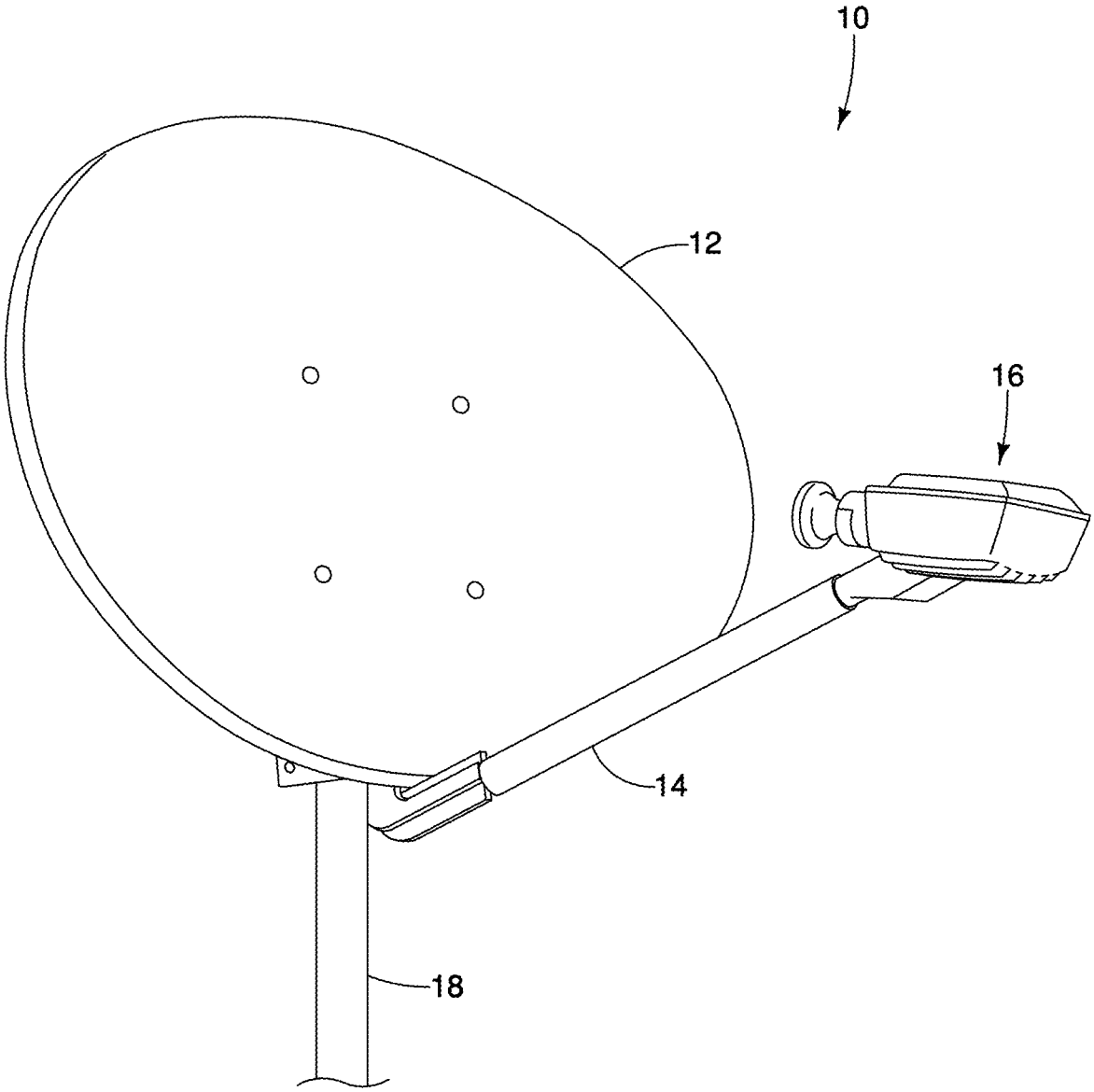
FIG. 1 is a perspective view of a satellite antenna that is equipped with a radio assembly in accordance with one embodiment.

Referring initially to FIG. 1, a satellite antenna 10 is illustrated in accordance with one embodiment. As illustrated in FIG. 1, the satellite antenna 10 includes an antenna reflector 12, a feed support arm 14 and a radio assembly 16. In the illustrated embodiment, the satellite antenna 10 is a parabolic antenna, for example. In the illustrated embodiment, the satellite antenna 10 is designed for millimeter wave applications, for example. Specifically, the satellite antenna 10 is designed for Q, U, V, E and W band applications. The satellite antenna 10 is capable of transmitting and receiving RF (radio frequency) signals to and from a satellite.

The antenna reflector 12 defocuses transmitted RF signals and focuses received RF signals. The antenna reflector 12 is fixedly coupled to an antenna mount on a pole 18 by a suitable reflector bracket using bolts and screws, for example. The feed support arm 14 supports the radio assembly 16 with respect to the antenna reflector 12. The feed support arm 14 also fixedly coupled to the reflector bracket using bolts, for example. The radio assembly 16 is fixedly coupled to the end of the feed support arm 14. The radio assembly 16 functions as one or more of a low noise amplifier, an up/down converter and a power amplifier, and is powered from an indoor unit. Specifically, in the illustrated embodiment, the radio assembly 16 serves as a millimeter wave transceiver. In particular, in the illustrated embodiment, the radio assembly 16 serves as Q, U, V, E and W band transceivers.

Figure 2:
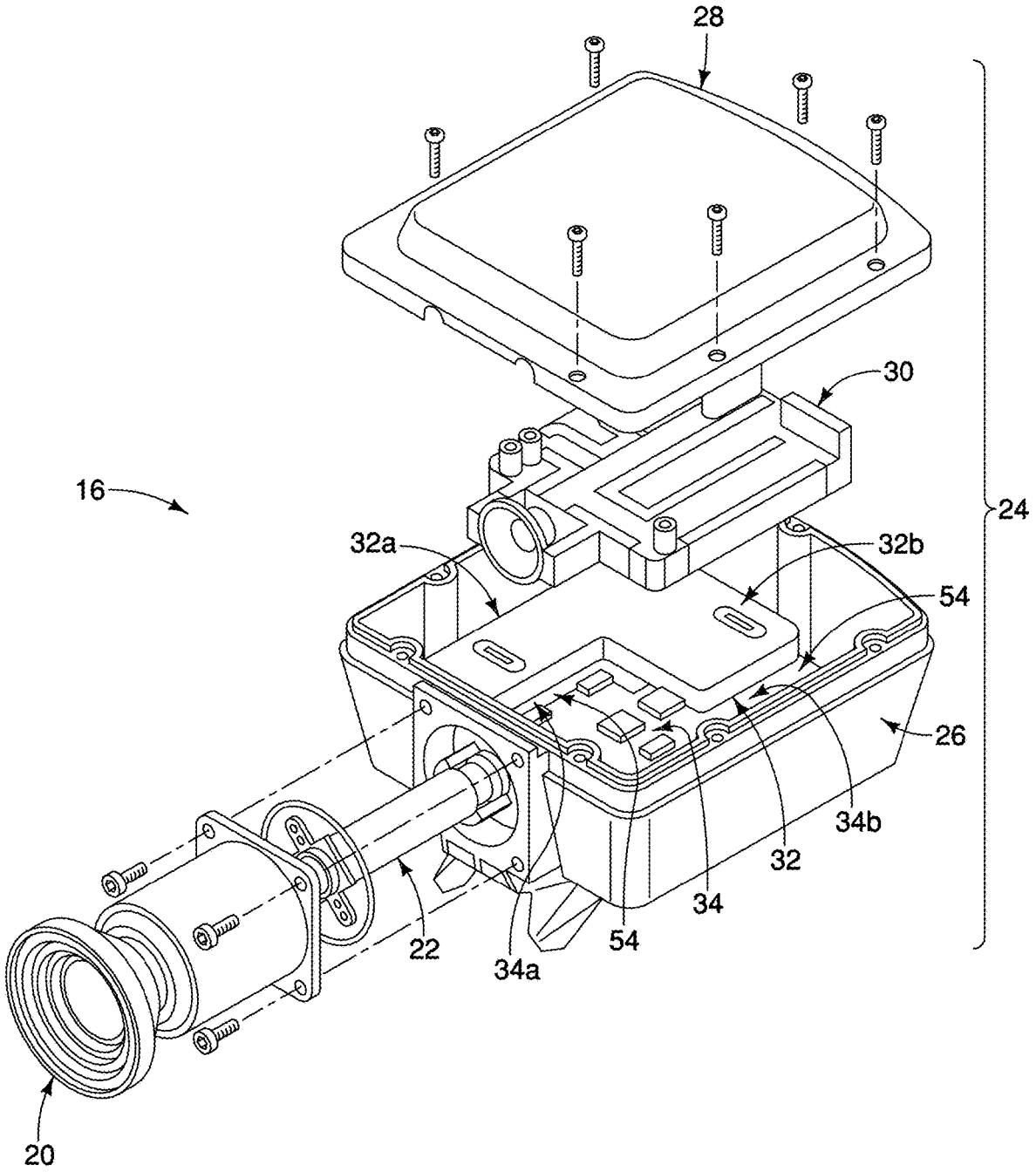
FIG. 2 is an exploded perspective view of the radio assembly illustrated in FIG. 1.

As illustrated in FIG. 2, the radio assembly 16 includes a feedhorn 20, a waveguide polarizer 22, and a radio transceiver 24. The feedhorn 20 is a horn antenna which conveys RF signals between the antenna reflector 12 and the radio transceiver 24. The waveguide polarizer 22 is electromagnetically coupled between the feedhorn 20 and the radio transceiver 24, and is set to match the polarization (i.e., left-hand circular polarization or right-hand circular polarization) required for the antenna or VSAT (Very Small Aperture Terminal) location.

As further illustrated in FIG. 2, the radio transceiver 24 has a housing 26, a cover 28, an OMT (Orthomode Transducer) 30, a shield 32 (e.g., a metal shield) and a circuit board 34 (e.g., a substrate). The OMT 30, the shield 32 and the circuit board 34 are disposed interior of the radio transceiver 24 that is defined by the housing 26 and the cover 28. In the illustrated embodiment, the feedhorn 20, the waveguide polarizer 22, the OMT 30, the shield 32 and the circuit board 34 are electromagnetically couple to each other to transfer RF signal from the feedhorn 20 to the circuit board 34 via the waveguide polarizer 22, the OMT 30 and the shield 32 for receiving an RF signal and to transfer the RF signal from the circuit board 34 to the feedhorn 20 via the shield 32, the OMT 30 and the waveguide polarizer 22 for transmitting the RF signal. The OMT 30 is a waveguide component that is made of suitable metallic material, and serves either to combine or to separate two orthogonally polarized signal paths. The OMT 30 is electromagnetically coupled between the waveguide polarizer 22 and the shield 32. The OMT 30 has an internal waveguide structure with a common port, a transmit port and a receive port. The OMT 30 transfers the RF signal from the transmit port to the common port through the internal waveguide structure while transmitting the RF signal, and transfers the RF signal from the common port to the receive port through the internal waveguide structure while receiving the RF signal.

In the illustrated embodiment, the shield 32 is a die cast plate that is disposed on the circuit board 34. The shield 32 is integrally formed as a one-piece, unitary member. Specifically, the shield 32 is made of suitable metallic material, such as zinc or zinc alloy. Of course, the shield 32 can be made of any suitable metallic material as needed and/or desired. The shield 32 has a transmit port 32*a* at a location corresponding to the transmit port of the OMT 30, and a receive port 32*b* at a location corresponding to the receive port of the OMT 30. The transmit and receive ports 32*a* and 32*b* are through holes that extend through the shield 32, respectively. In the illustrated embodiment, the configurations of the transmit port 32*a* and the receive port 32*b* are substantially identical to each other, and thus the detailed configurations of the transmit port 32*a* and the receive port 32*b* will be explained by referring to FIG. 3. However, of course, the transmit port 32*a* and the receive port 32*b* can be different from each other in their dimensions according to the desired frequency bands transmitted through the transmit port 32*a* and the receive port 32*b*, respectively.

The circuit board 34 has various electric circuits to function as low noise amplifier, up/down converter and power amplifier for RF signal that is transmitted from the circuit board 34 and fir RF signal that has been received b the circuit board 34. In the illustrated embodiment, as illustrated in FIG. 2, the circuit board 34 has a transmit port 34*a* at a location corresponding to the transmit port 32*a* of the shield 32, and a receive port 34*b* at a location corresponding to the receive port 32*b* of the shield 32. The circuit board 34 transmits RF signal from the transmit port 34*a* while the satellite antenna 10 transmits RF signal, and receives RF signal at the receive port 34*b* while the satellite antenna 10 receives RF signal. In particular, the shield 32 transfers RF signal from the transmit port 34*a* of the circuit board 34 to the transmit port of the OMT 30 through the transmit port 32*a* of the shield 32 while transmitting RF signal, and transfers RF signal from the receive port of the OMT 30 to the receive port 34*b* of the circuit board 34 through the receive port 32*b* while receiving RF signal. In the illustrated embodiment, the transmit port 34*a* and the receive port 34*b* are located at different locations on the circuit board 34 corresponding to the transmit port 32*a* and the receive port 32*b* of the shield 32, respectively. In the illustrated embodiment, the configurations of the transmit port 34*a* and the receive port 34*b* are substantially identical to each other, and thus the detailed configurations of the transmit port 34*a* and the receive port 34*b* will be explained by referring e.g. to FIG. 3. However, of course, the transmit port 34*a* and the receive port 34*b* can be different from each other in their dimensions according to the desired frequency bands transmitted through the transmit port 34*a* and the receive port 34*b*, respectively.

Figure 3:
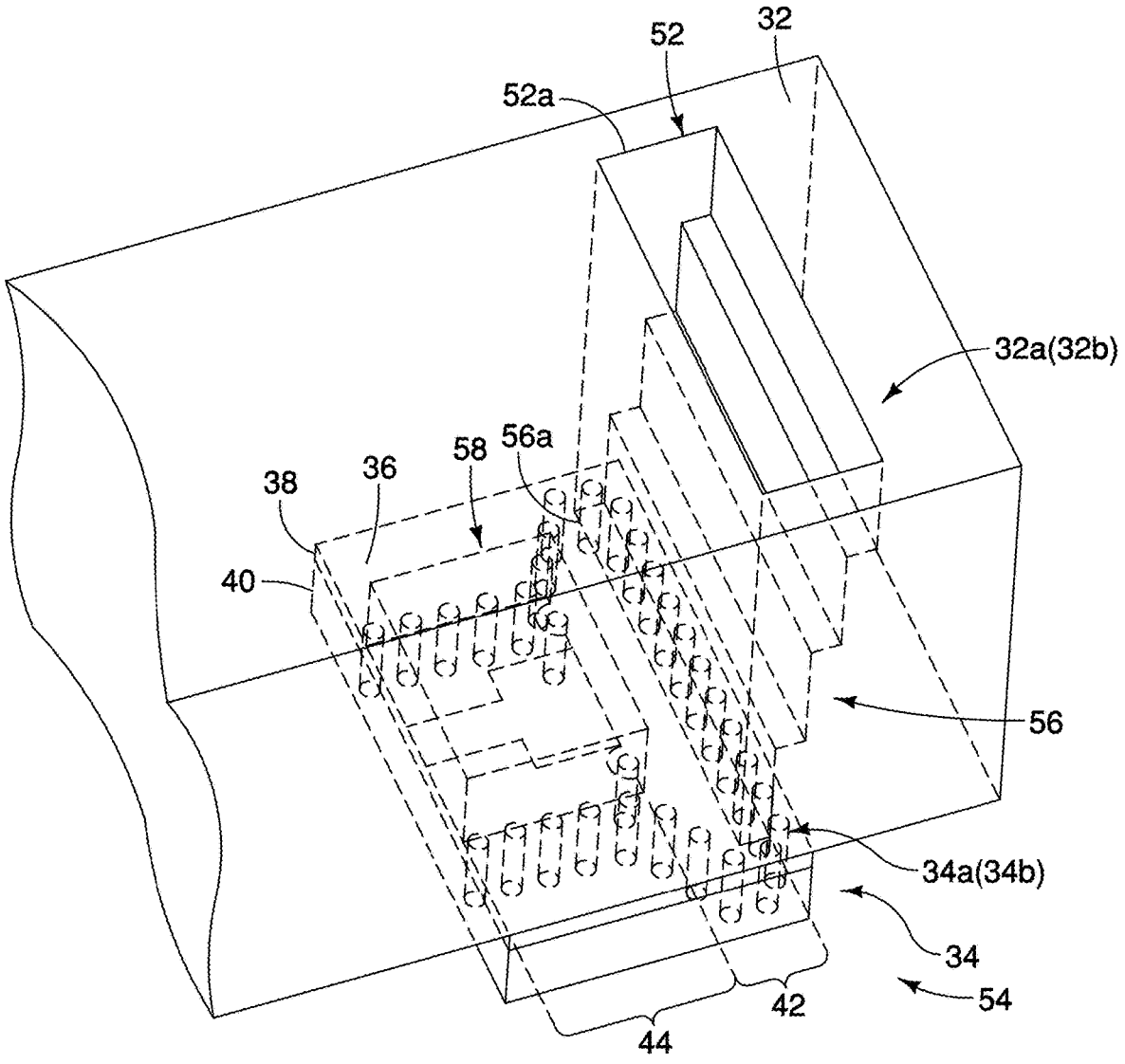
FIG. 3 is a perspective view of a microstrip-to-waveguide transition of the radio assembly illustrated in FIG. 2.
Figure 4:
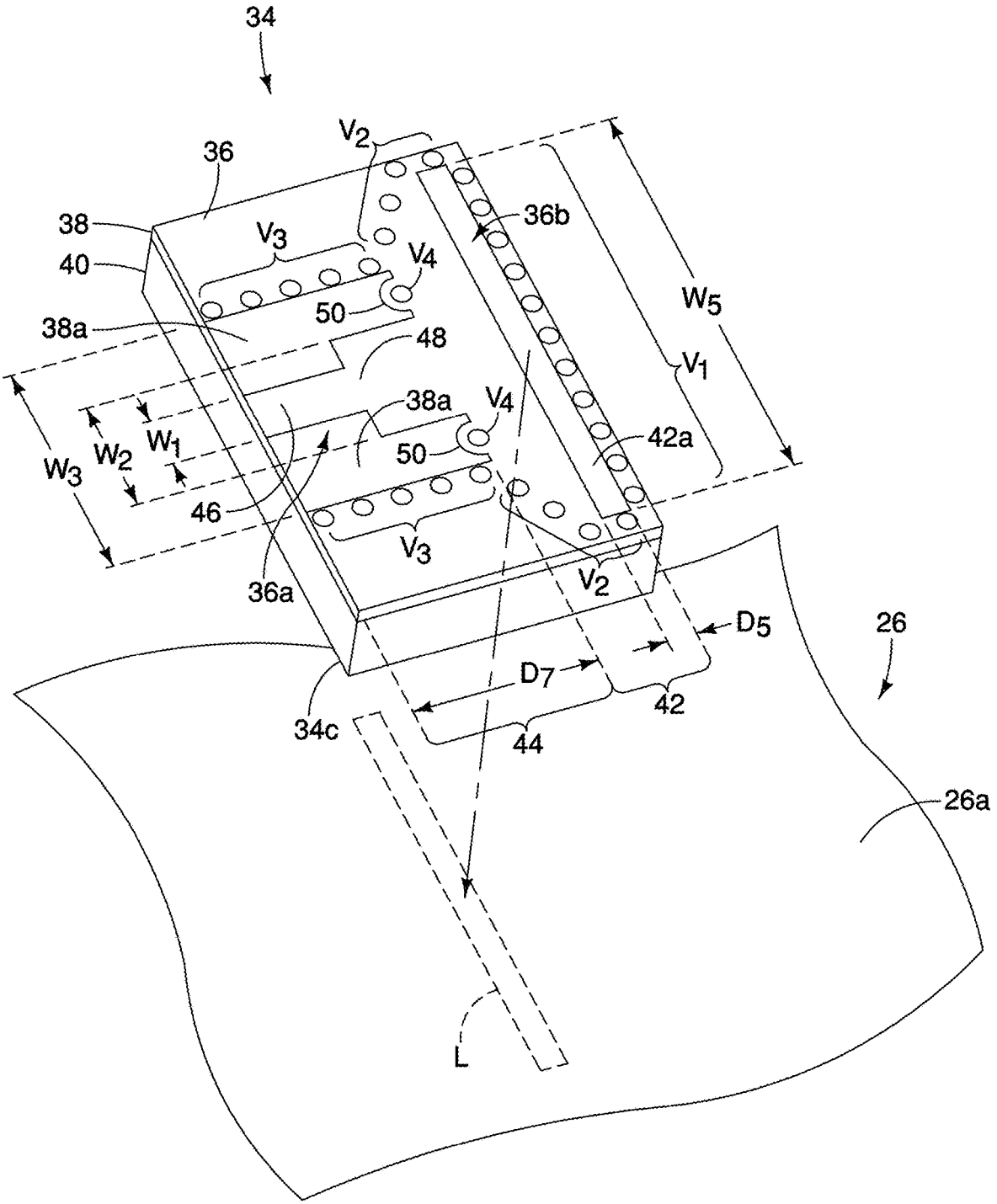
FIG. 4 is a perspective view of a circuit board of the microstrip-to-waveguide transition illustrated in FIG. 3.
Figure 5:
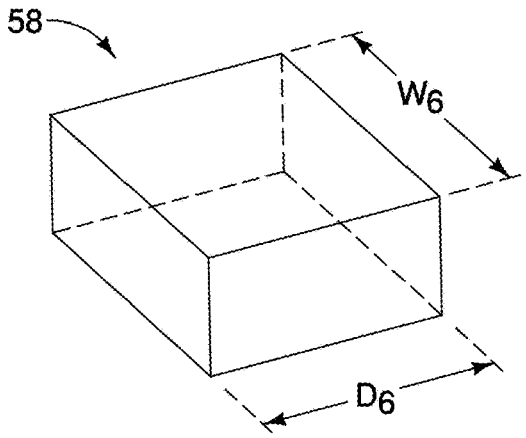
FIG. 5 is a perspective view of a cavity on a metal shield of the microstrip-to-waveguide transition illustrated in FIG. 3.

As further illustrated in FIGS. 3 and 4, the circuit board 34 is a multilayer PCB (Printed Circuit Board) with typical three-layer structure. Specifically, the circuit board 34 has a metal layer 36, a dielectric layer 38 and a ground layer 40. The metal layer 36 is formed on a top surface 38*a* of the dielectric layer 38. In the illustrated embodiment, the metal layer 36 is a copper layer. However, the metal layer 36 can be made of any suitable material as needed and/or desired. The metal layer 36 is etched to form an etched pattern having a microstrip line 36*a* at each of the transmit port 34*a* and the receive port 34*b*. Furthermore, the etched pattern of the metal layer 36 has an aperture 36*b* at each of the transmit port 34*a* and the receive port 34*b*. The aperture 36*b* extends through the metal layer 36 to expose the top surface 38*a* of the dielectric layer 38 therethrough. In the illustrated embodiment, the aperture 36*b* has a rectangular shape. The dielectric layer 38 is disposed between the metal layer 36 and the ground layer 40. The dielectric layer 38 is made of dielectric material, such as porcelain, mica, glass, plastics, that are suitable for building up the PCB. The ground layer 40 is electrically grounded. The ground layer 40 is made of metallic material.

In the illustrated embodiment, as illustrated in FIGS. 3 and 4, the circuit board 34 has a substrate integrated waveguide (SIW) section 42 (e.g., a substrate integrated waveguide) and a microstrip section 44 at each of the transmit port 34*a* and the receive port 34*b*. In the illustrated embodiment, the SIW section 42 forms a dielectric filled waveguide, and has a 90 degree substrate integrated waveguide bend section 42*a* at an end portion thereof.

Specifically, the 90 degree substrate integrated waveguide bend section 42*a* is disposed at the aperture 36*b*. Thus, in the illustrated embodiment, the SIW section 42 is covered by the metal layer 36 except at the 90 degree substrate integrated waveguide bend section 42*a*. In the illustrated embodiment, the SIW section 42 has a tapered shape that diverges toward 90 degree substrate integrated waveguide bend section 42*a*. Specifically, as illustrated in FIG. 4, the SIW section 42 is electromagnetically shielded by a plurality of via walls or holes V1 and V2 that extends through the circuit board 34. Specifically, the via walls. V1 and V2 are arranged with respect to each other to define a periphery of the SIW section 42. The via walls V1 and V2 include plated vias. In the illustrated embodiment, the via walls V1 and V2 are arranged to surround the aperture 36*b*. In particular, the via walls V1 are arranged with respect to each other along a long edge of the aperture 36*b*. The via walls V2 are arranged in two rows that diverge with respect to each other from the microstrip section 44 toward the ends of the row of the via walls V1.

The microstrip section 44 is arranged next to the SIW section 42. The SIW section 42 is electromagnetically coupled to the microstrip section 44 and the microstrip line 46 is the input/output (I/O) of the microstrip section 44. As illustrated in FIG. 4, the microstrip section 44 has a 50 ohm track 46 and an impedance stepped down microstrip line impedance transformer 48 that is connected to the 50 ohm track 46 in series. The 50 ohm track 46 is provided for the I/O for an LNB (Low Noise Block) or a power amplifier, for example. The 50 ohm track 46 has a width W1, while the impedance stepped down microstrip line impedance transformer 48 has an increased width W2 at an end portion of the microstrip line 36*a* (i.e., W1<W2). The impedance stepped down microstrip line impedance transformer 48 is utilized for impedance transformation between the SIW section 42 and the standard 50 ohm microstrip impedance. The microstrip section 44 is electromagnetically shielded by a pair of rows of via walls V3. The via walls V3 extend through the circuit board 34. The via walls V3 include plated vias. The via walls V3 are arranged in two rows that are parallel to each other and spaced with respect to each other by a width W3 that is larger than the width W2 (i.e., W2<W3). Specifically, in the illustrated embodiment, the via walls V3 of each of the rows are arranged with respect to each other along a direction in which the microstrip line 36*a* extends. Furthermore, the metal layer 36 has a pair of protruding portions 50 between an end portion of the impedance stepped down microstrip line impedance transformer 48 and the pair of the rows of the via walls V3, respectively. In the illustrated embodiment, the microstrip section 44 further has via walls V4 that extend through the circuit board 34 at the protruding portions 50 of the metal layer 36, respectively. The via walls V4 include plated vias.

With these via walls V1, V2, V3 and V4 in the SIW section 42 and the microstrip section 44, the electric field propagates unidirectionally through the SIW section 42 and the microstrip section 44. Specifically, the electric field is gradually transferred between the 50 ohm track 46 of the microstrip line 36*a* and the 90 degree substrate integrated waveguide bend section 42*a* through the tapered SIW section 42 and the microstrip section 44. Also, in the illustrated embodiment, these via walls V1, V2, V3 and V4 in the circuit board 34 are arranged to serve as solid electrical walls to confine electromagnetic field within the SIW section 42 and the microstrip section 44.

In the illustrated embodiment, as illustrated in FIG. 3, the transmit and receive ports 32*a* and 32*b* have air-filled waveguides 52 that transfer RF signals between the transmit and receive ports of the OMT 30 and the circuit board 34, respectively. Specifically, the waveguides 52 are arranged perpendicularly relative to the circuit board 34. The waveguides 52 are electromagnetically coupled to the SIW sections 42 of the transmit and receive ports 34*a* and 34*b* of the circuit board 34 at the 90 degree substrate integrated waveguide bend sections 42*a*, respectively. With this configuration, as illustrated in FIG. 3, microstrip-to-waveguide transitions 54 are formed between the shield 32 and the circuit board 34 to couple the electromagnetic fields between the shield 32 and the circuit board 34. As mentioned above, in the illustrated embodiment, the feedhorn 20, the waveguide polarizer 22, the OMT 30, the shield 32 and the circuit board 34 are electromagnetically couple to each other. Thus, with the radio assembly 16, the feedhorn 20 is electromagnetically coupled to the waveguides 52 of the microstrip-to-waveguide transitions 54.

Figure 6:
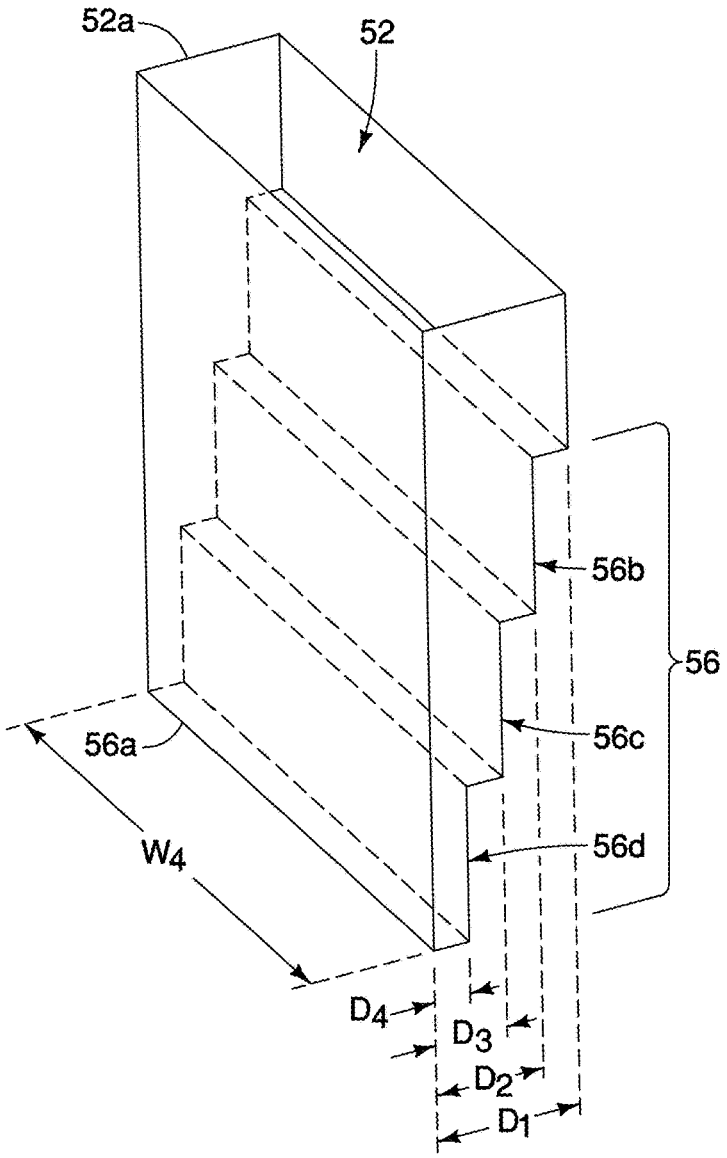
FIG. 6 is a perspective view of a waveguide impedance transformer in the microstrip-to-waveguide transition illustrated in FIG. 3.

As further illustrated in FIGS. 3 and 6, the waveguides 52 have hollow stepped waveguide impedance transformers 56 at end portions thereof, respectively. As illustrated in FIG. 3, the waveguides 52 (the waveguide impedance transformers 56) each extend perpendicular to the circuit board 34. The waveguide impedance transformers 56 have distal ends 56*a* that are located at the apertures 36*b* of the metal layer 36, respectively. The distal ends 56*a* of the stepped waveguide impedance transformers 56 have rectangular end openings that correspond to the apertures 36*b* of the metal layer 36, respectively.

In the illustrated embodiment, the waveguide impedance transformers 56 are provided to gradually transfer the electric field between the 90 degree substrate integrated waveguide bend sections 42*a* of the SIW sections 42 of the circuit board 34 and rectangular output/input ends 52*a* of the waveguides 52 (i.e., output/input ends of the transmit and receive ports 32*a* and 32*b* that face transmit and receive port of the OMT 30), respectively. In particular, the waveguide impedance transformers 56 are utilized for impedance transformation between the 90 degree substrate integrated waveguide bend sections 42*a* of the SIW sections 42 of the circuit board 34 and the rectangular output/input ends 52*a* of the waveguides 52 (i.e., the output/input ends of the transmit and receive ports 32*a* and 32*b* that face transmit and receive port of the OMT 30), respectively. In particular, as illustrated in FIGS. 3 and 6, the waveguide impedance transformers 56 have an inner dimension that decreases toward the distal ends 56*a*, respectively. Specifically, the inner dimension of the waveguide impedance transformers 56 stepwisely decreases toward the distal ends 56*a*, respectively. In the illustrated embodiment, as illustrated in FIG. 6, the waveguide impedance transformers 56 each have three stages or steps 56*b*, 56*c* and 56*d*.

More specifically, as illustrated in FIG. 6, the output/input ends 52*a* of the waveguides 52 has an inner dimension D1, while the waveguide impedance transformers 56 has the three stages 56*b*, 56*c* and 56*d* with inner dimensions D2, D3 and D4 that stepwisely decrease toward the distal ends 56*a*, respectively (i.e., D1>D2<D3<D4). Thus, the end opening at the distal ends 56*a* has the inner dimension D4 that matches a dimension D5 of the short sides of the apertures 36*b* of the metal layer 36 (i.e., D4=D5), as illustrated in FIGS. 3 to 6. Also, in the illustrated embodiment, the waveguides 52 has a constant width W4 that matches a dimension W5 of the long sides of the apertures 36*b* of the metal layer 36 (i.e., W4=W5), as illustrated in FIGS. 3 to 6.

In the illustrated embodiment, the shield 32 further includes air-filled cavities 58 on a bottom surface that faces the circuit board 34. The cavities 58 opens on the bottom surface of the shield to cover the microstrip sections 44 at the transmit and receive ports 34*a* and 34*b*, respectively. Specifically, in the illustrated embodiment, the cavities 58 are shielded air boxes. In the illustrated embodiment, the cavities 58 cover the impedance stepped down microstrip line impedance transformers 48, respectively. In the illustrated embodiment, the cavities 58 have a width W6 that matches the width W3 of the microstrip sections 44, and an inner dimension D6 that matches a lengthwise dimension D7 of the microstrip sections 44.

Figure 7:
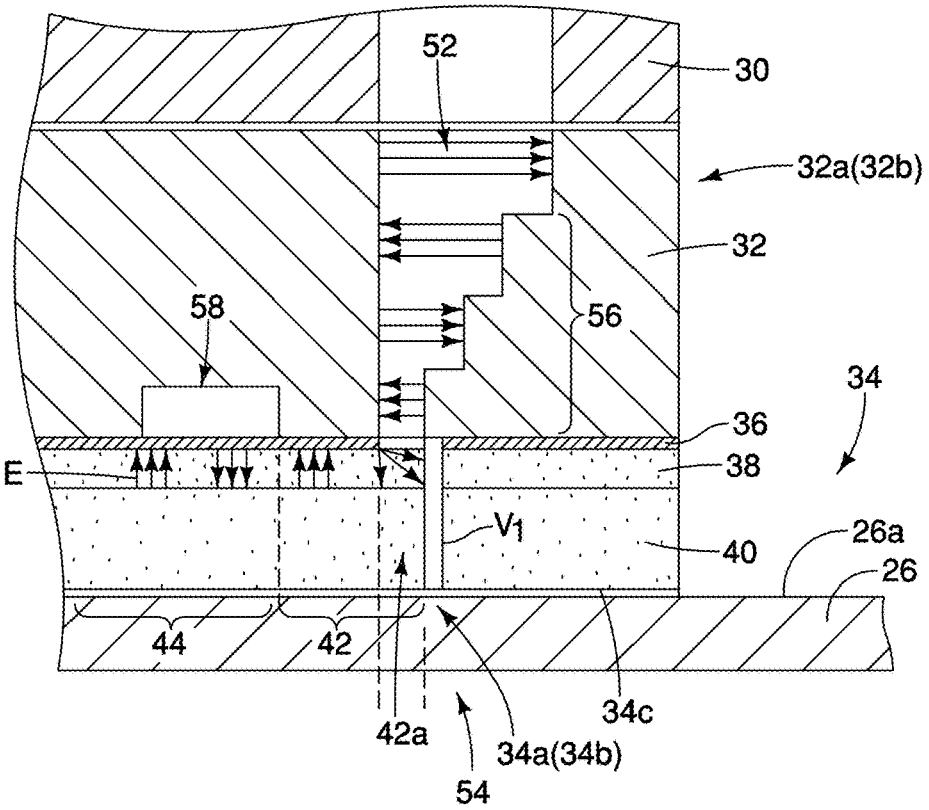
FIG. 7 is a schematic diagram showing an electric field propagation through the microstrip-to-waveguide transition illustrated in FIG. 3.

Referring now to FIG. 7, the electric field propagates through the microstrip-to-waveguide transition 54 at each of the transmit and receive ports 34*a* and 34*b*. As illustrated in FIG. 7, at the transmit port 34*a*, the electric field E unidirectionally propagates within the dielectric layer 38 of the circuit board 34 from the microstrip section 44 to the SIW section 42. At the 90 degree substrate integrated waveguide bend section 42*a* of the SIW section 42, the electric field E is bent 90 degrees to propagate toward the transmit port of the OMT 30 through the waveguide 52 of the transmit port 32*a* of the shield 32. Also, at the receive port 34*b*, the electric field E from the receive port of the OMT 30 unidirectionally propagates through the waveguide 52 of the receive port 32*b* of the shield 32 toward the receive port 34*b*. At the 90 degree substrate integrated waveguide bend section 42*a* of the SIW section 42, the electric field E is bent 90 degrees to propagate within the dielectric layer 38 of the circuit board 34 from the SIW section 42 to the microstrip section 44.

Figure 8:
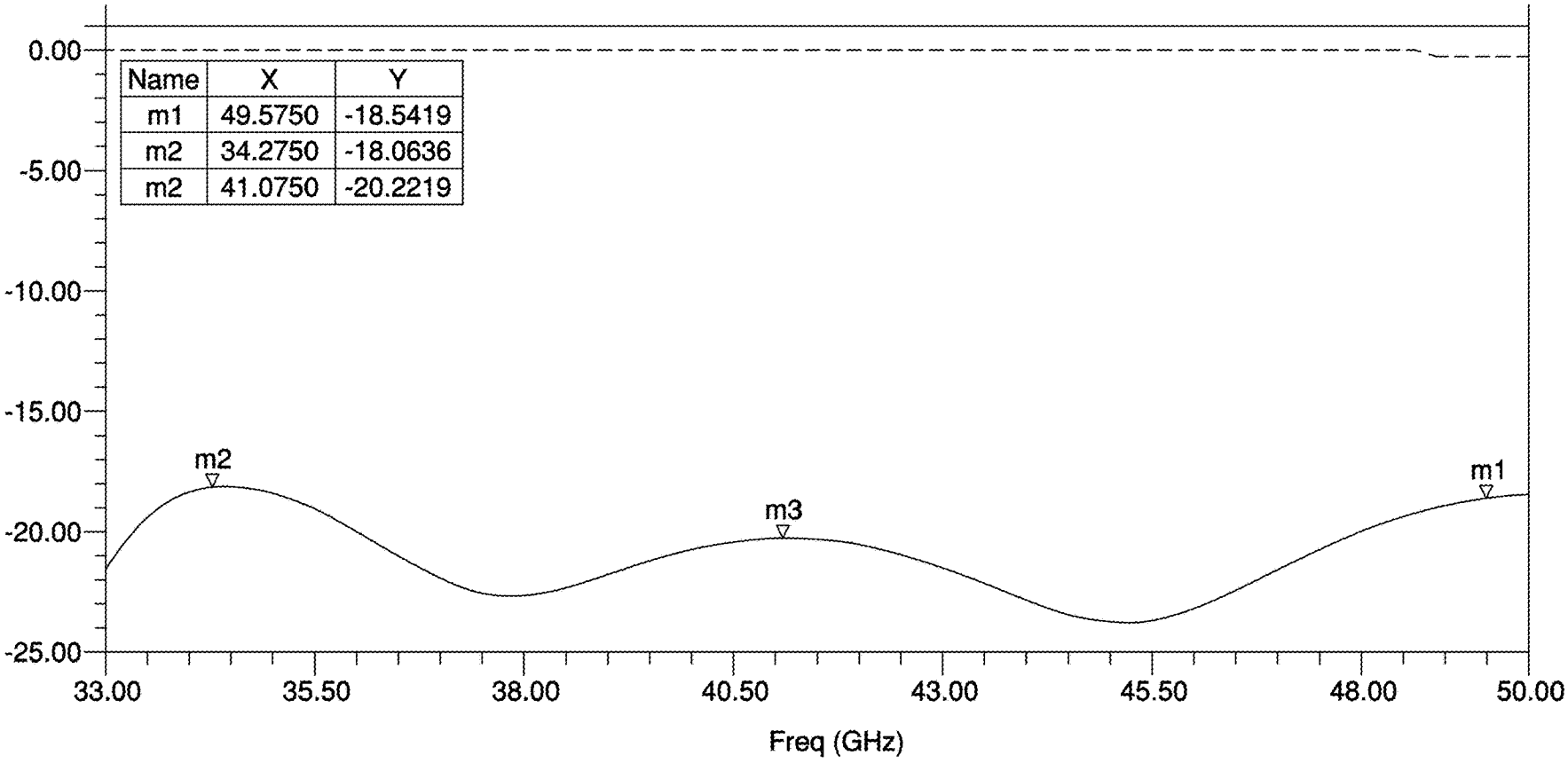
FIG. 8 is a simulation result showing simulated reflection and transmission performances of the microstrip-to-waveguide transition illustrated in FIG. 3.

FIG. 8 illustrates a simulation result showing simulated reflection and transmission performances vs. frequency in GHz of the microstrip-to-waveguide transition 54 as shown in FIG. 7. The microstrip-to-waveguide transition 54 is modeled and simulated by High Frequency Structure Simulator (HFSS™). It is known that the simulation results by the HFSS™ well match the experimental results of the actual products. Specifically, FIG. 8 illustrates simulated reflection and transmission performances of the microstrip-to-waveguide transition 54 for the full Q band. The solid line indicates the reflection performance with markers m1, m2 and m3 indicating reflection performance at specified frequencies and the dashed line indicates the transmission performance. As illustrated in FIG. 8, excellent reflection and transmission performances over the full Q band can be achieved by the microstrip-to-waveguide transition 54.

In the illustrated embodiment, with the configuration of the microstrip-to-waveguide transition 54, an ultra-wide-band or full band microstrip-to-waveguide transition for millimeter wave radio applications can be provided.

In particular, in the illustrated embodiment, the microstrip-to-waveguide transition 54 is free of a back-short at a location corresponding to the 90 degree substrate integrated waveguide bend section 42*a* of the SIW section 42. Specifically, as illustrated in FIGS. 4 and 7, the circuit board 34 is disposed on a bottom surface 26*a* of the housing 26. The bottom surface 26*a* has various cavities that receives various electric circuits mounted on a bottom surface 34*c* of the circuit board 34. However, the bottom surface 26*a* does not have a back-short or recess at locations L (see, FIG. 4) that overlap the 90 degree substrate integrated waveguide bend sections 42*a* of the SIW sections 42 or the apertures 36*b* of the metal layer 36 as viewed in a direction perpendicular to the bottom surface 26*a*. In other words, the bottom surface 26*a* has flat regions or surfaces at the locations L. Furthermore, in the illustrated embodiment, the bottom surface 34*c* of the circuit board 34 does not have a recessed portion at the substrate integrated waveguide bend sections 42*a*. In other words, the bottom surface 34*c* of the circuit board 34 has flat regions or surfaces at the substrate integrated waveguide bend sections 42*a*. Moreover, in the illustrated embodiment, as illustrated in FIGS. 3 and 4, the metal layer 36 does not have a bandwidth limited radiating patch at the transmit and receive ports 34*a* and 34*b*. Specifically, no parts of the metal layer 36 is disposed inside the rectangular end openings of the waveguide impedance transformers 56.

Accordingly, in the illustrated embodiment, the need of the bandwidth limited radiating patch and the corresponding back-short is eliminated. Thus, even if the microstrip-to-waveguide transition 54 is designed for higher frequency band applications, such as millimeter wave applications, no high tolerance on the processing of the housing 26 and the circuit board 34 (e.g., no high tolerance on the thickness of the circuit board 34 at the substrate integrated waveguide bend section 42*a*) is necessary. Furthermore, even for low loss applications, there is no need to remove materials between the radiating patch and the corresponding back-short. Therefore, large scale batch production becomes possible while cutting the manufacturing cost, boosting the multilayer PCB board yield and improving the electrical performance.

Figure 9:
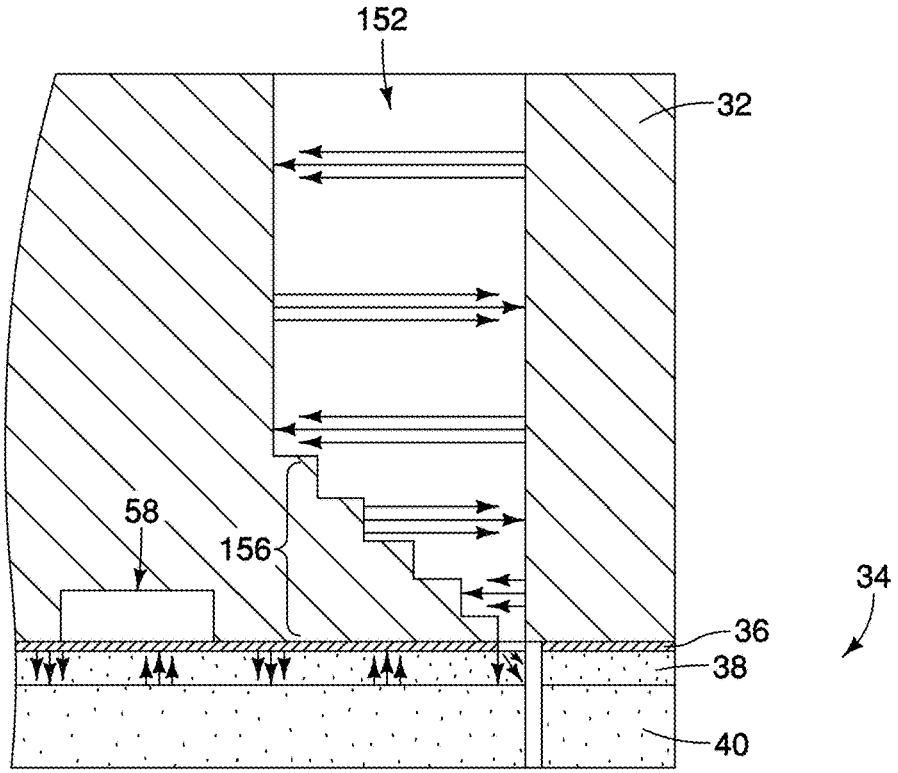
FIG. 9 is a schematic diagram showing an electric field propagation through a microstrip-to-waveguide transition in accordance with a modification example.

In the illustrated embodiment, as illustrated in FIG. 6, the waveguide impedance transformer 56 has three stages 56*b*, 56*c* and 56*d*. However, the number of the stages of the waveguide impedance transformer is not limited to 3, and can be fewer or more than three as needed and/or desired. For example, a waveguide impedance transformer 156 of a waveguide 152 in accordance with a modification example can have five stages, as shown in FIG. 9.

In the illustrated embodiment, as illustrated in FIGS. 3 and 6, the waveguide 52 is configured such that an inner surface that is located closer to the cavity 58 is formed as a flat surface. However, the configuration of a waveguide is not limited to this, and, as illustrated in FIG. 9, the waveguide 152 can be configured such that an inner surface that is located father away from the cavity 58 can be formed as a flat surface.

In the illustrated embodiment as illustrated in FIG. 6, the waveguides 52 have the stepped waveguide impedance transformers 56, respectively. However, the shape of the waveguide impedance transformers is not limited to this. The waveguides 52 can have tapered waveguide impedance transformers, for example.

In the illustrated embodiment as illustrated in FIG. 3, the microstrip-to-waveguide transitions 54 are provided at the transmit port 34*a* and the receive port 34*a*. However, the microstrip-to-waveguide transition 54 can be provided at only one of the transmit port 34*a* and the receive port 34*a*.

In the illustrated embodiment as illustrated in FIG. 3, the waveguides 52 and the cavities 58 are provided on the shield 32 that is formed as a one-piece, unitary member. However, the waveguides 52 and the cavities 58 can be formed on different shields that are independently formed as separate members.

In the illustrated embodiment as illustrated in FIG. 7, the waveguides 52 and the cavities 58 are provided on the shield 32. However, when the OMT 30 is directly coupled to the circuit board 34, the waveguides 52 and the cavities 58 can be provided on the OMT 30. In particular, in this case, the waveguides 52 can be provided at the transmit and receive ports of the OMT 30.

In the illustrated embodiment as illustrated in FIG. 1, as illustrated in FIG. 4, the microstrip line impedance transformer 48 of the microstrip line section 44 has one stage impedance transform rectangular microstrip line. However, the microstrip line impedance transformer 48 can have more stages of the rectangular microstrip lines or a different shape, such as a tapered shape that diverges toward the SIW section 42.

In the illustrated embodiment as illustrated in FIG. 1, the radio assembly 16 is used for the satellite antenna 10. However, the radio assembly 16 can be used for different types of antenna and applications.

In the illustrated embodiment as illustrated in FIG. 2, the microstrip-to-waveguide transitions 54 is provided to the radio assembly 16. However, the microstrip-to-waveguide transitions 54 can be provided to different types of radio devices.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A microstrip-to-waveguide transition comprising:

a substrate having a metal layer, a ground layer and a dielectric layer disposed between the metal layer and the ground layer, the substrate including a microstrip line impedance transformer and a substrate integrated waveguide that is electromagnetically coupled to the microstrip line impedance transformer, the substrate integrated waveguide having a 90 degree substrate integrated waveguide bend section at an end portion thereof;

a metal shield having a cavity that covers the microstrip line impedance transformer, the metal shield enclosing therein a waveguide arranged perpendicularly relative to the substrate, the waveguide being electromagnetically coupled to the substrate integrated waveguide at the 90 degree substrate integrated waveguide bend section; and the microstrip-to-waveguide transition being free of a back-short at a location corresponding to the 90 degree substrate integrated waveguide bend section.

2. A microstrip-to-waveguide transition comprising:

a substrate having a metal layer, a ground layer and a dielectric layer disposed between the metal layer and the ground layer, the substrate including a microstrip line impedance transformer and a substrate integrated waveguide that is electromagnetically coupled to the microstrip line impedance transformer, the substrate integrated waveguide having a 90 degree substrate integrated waveguide bend section at an end portion thereof; and a waveguide arranged perpendicularly relative to the substrate, the waveguide being electromagnetically coupled to the substrate integrated waveguide at the 90 degree substrate integrated waveguide bend section, the metal layer having an aperture at the 90 degree substrate integrated waveguide bend section, the aperture located at an edge of a via wall defining a periphery of the 90 degree substrate integrated waveguide bend section, the microstrip-to-waveguide transition being free of a back-short at a location corresponding to the 90 degree substrate integrated waveguide bend section.

3. A microstrip-to-waveguide transition comprising:

a substrate having a metal layer, a ground layer and a dielectric layer disposed between the metal layer and the ground layer, the substrate including a microstrip line impedance transformer and a substrate integrated waveguide that is electromagnetically coupled to the microstrip line impedance transformer, the substrate integrated waveguide having a 90 degree substrate integrated waveguide bend section at an end portion thereof; and a waveguide arranged perpendicularly relative to the substrate, the waveguide being electromagnetically coupled to the substrate integrated waveguide at the 90 degree substrate integrated waveguide bend section, the microstrip-to-waveguide transition being free of a back-short at a location corresponding to the 90 degree substrate integrated waveguide bend section, the microstrip line impedance transformer being electromagnetically shielded by a pair of rows of via walls that extends through the substrate, the via walls of each of the rows being arranged with respect to each other along a direction in which the microstrip line impedance transformer extends, and the metal layer having a pair of protruding portions between an end portion of the microstrip line impedance transformer and the pair of the rows of the via walls, respectively.

4. The microstrip-to-waveguide transition according to claim 3, wherein the pair of the rows of the via walls extend through the substrate at the protruding portions of the metal layer, respectively.

5. A microstrip-to-waveguide transition comprising:

a substrate having a metal layer, a ground layer and a dielectric layer disposed between the metal layer and the ground layer, the substrate including a microstrip line impedance transformer and a substrate integrated waveguide that is electromagnetically coupled to the microstrip line impedance transformer, the substrate integrated waveguide having a 90 degree substrate integrated waveguide bend section at an end portion thereof; and a waveguide arranged perpendicularly relative to the substrate, the waveguide being electromagnetically coupled to the substrate integrated waveguide at the 90 degree substrate integrated waveguide bend section, the microstrip-to-waveguide transition being free of a back-short at a location corresponding to the 90 degree substrate integrated waveguide bend section, the waveguide having a hollow waveguide impedance transformer having an inner dimension that stepwisely decreases toward an end thereof.

6. A microstrip-to-waveguide transition comprising:

a substrate having a metal layer, a ground layer and a dielectric layer disposed between the metal layer and the ground layer, the substrate including a microstrip line impedance transformer and a substrate integrated waveguide that is electromagnetically coupled to the microstrip line impedance transformer, the substrate integrated waveguide having a 90 degree substrate integrated waveguide bend section at an end portion thereof; and a waveguide arranged perpendicularly relative to the substrate, the waveguide being electromagnetically coupled to the substrate integrated waveguide at the 90 degree substrate integrated waveguide bend section, the metal layer having an aperture at the 90 degree substrate integrated waveguide bend section, the microstrip-to-waveguide transition being free of a back-short at a location corresponding to the 90 degree substrate integrated waveguide bend section, the waveguide having a hollow waveguide impedance transformer at an end portion thereof, the waveguide impedance transformer having an inner dimension that decreases toward an end thereof.

7. The microstrip-to-waveguide transition according to claim 6, wherein the waveguide impedance transformer extends perpendicular to the substrate.

8. The microstrip-to-waveguide transition according to claim 2, wherein the substrate integrated waveguide has a tapered shape that diverges toward the 90 degree substrate integrated waveguide bend section.

9. The microstrip-to-waveguide transition according to claim 8, wherein the substrate integrated waveguide is covered by the metal layer except at the 90 degree substrate integrated waveguide bend section.

10. The microstrip-to-waveguide transition according to claim 8, wherein the microstrip line impedance transformer has an increased width at an end portion thereof.

11. The microstrip-to-waveguide transition according to claim 2, wherein the substrate integrated waveguide is electromagnetically shielded by a plurality of via walls that extends through the substrate, the via walls being arranged with respect to each other to define a periphery of the substrate integrated waveguide.

12. The microstrip-to-waveguide transition according to claim 11, wherein the plurality of via walls include plated vias.

13. The microstrip-to-waveguide transition according to claim 2, wherein the waveguide has a distal end that is located at the aperture of the metal layer.

14. The microstrip-to-waveguide transition according to claim 13, wherein the aperture of the metal layer has a rectangular shape, and the distal end of the waveguide has a rectangular end opening that corresponds to the aperture of the metal layer.

15. A radio assembly comprising:

a feed horn; and the microstrip-to-waveguide transition according to claim 8, the feed horn being electromagnetically coupled to the waveguide of the microstrip-to-waveguide transition.

16. The microstrip-to-waveguide transition according to claim 8, wherein the dielectric layer includes a top surface and a bottom surface, and the metal layer and the 90 degree substrate integrated waveguide bend section are located along the top surface of the dielectric layer.

17. The microstrip-to-waveguide transition according to claim 8, wherein the microstrip line impedance transformer is electromagnetically shielded by a pair of rows of via walls that extends through the substrate, the via walls of each of the rows being arranged with respect to each other along a direction in which the microstrip line impedance transformer extends.

18. The microstrip-to-waveguide transition according to claim 8, wherein the substrate integrated waveguide extends parallel to the metal layer along the same surface.

19. The microstrip-to-waveguide transition according to claim 8, wherein the substrate integrated waveguide extends adjacent to the metal layer along the same surface.

* * * * *